US007823486B2

(12) United States Patent
Wise

(10) Patent No.: US 7,823,486 B2
(45) Date of Patent: Nov. 2, 2010

(54) CORDLESS MOTOR ASSISTED TORQUE WRENCH

(76) Inventor: Robert W. Wise, 365 Ely Rd., Petaluma, CA (US) 94954

( * ) Notice: Subject to any disclaimer, the term of this patent is extended or adjusted under 35 U.S.C. 154(b) by 22 days.

(21) Appl. No.: 12/151,909

(22) Filed: May 9, 2008

(65) Prior Publication Data

US 2009/0277313 A1 Nov. 12, 2009

(51) Int. Cl.
*B25B 23/142* (2006.01)
*B25B 21/00* (2006.01)

(52) U.S. Cl. ..... 81/479; 81/467; 81/57.13

(58) Field of Classification Search ..... 81/479, 81/478, 467, 469, 177.2, 177.7, 474, 57.13
See application file for complete search history.

(56) References Cited

U.S. PATENT DOCUMENTS 3,733,935 A * 5/1973 Tsuji ..... 81/483
3,905,429 A * 9/1975 Berger ..... 81/57.13
3,939,924 A * 2/1976 Grabovac ..... 81/57.11
4,290,329 A * 9/1981 Green ..... 81/477
4,805,404 A * 2/1989 Dupin ..... 81/470
6,293,172 B1 * 9/2001 Smith ..... 81/57.13
6,526,853 B2 3/2003 Jenkins
6,981,436 B2 1/2006 Becker et al.
7,069,816 B1 7/2006 Saathoff et al.
7,156,187 B1 * 1/2007 Townsan ..... 81/57.13
7,234,378 B2 6/2007 Reynertson, Jr.
2005/0279197 A1 * 12/2005 Wottreng et al. ..... 81/469
2009/0126535 A1 * 5/2009 Cho et al. ..... 81/57.29

* cited by examiner

*Primary Examiner*—Hadi Shakeri
(74) *Attorney, Agent, or Firm*—Black Lowe & Graham PLLC

(57) ABSTRACT

A cordless motor assisted torque wrench. In an example embodiment, the torque wrench includes an elongated housing adapted to enclose an elongated battery pack, a drive head pivotably connected to a first end of the elongated housing at a pivot connection, an electronic torque setting device operable to receive a desired torque setting from a user, a torque sensing device for sensing a level of torque applied by the wrench to a workpiece, a motor disposed within the head, and a torque limiter configured to limit the torque applied by the wrench to a workpiece based on the desired torque setting and the level of torque sensed by the torque sensing device. The elongated housing preferably includes a first segment and a second segment slidably coupled to form a telescopic elongated housing that is configurable into at least two lengths.

1 Claim, 5 Drawing Sheets

CORDLESS MOTOR ASSISTED TORQUE WRENCH

FIELD OF THE INVENTION

This invention relates generally to torque wrenches. More specifically, the invention relates to powered torque wrenches.

BACKGROUND OF THE INVENTION

Modern, tubeless automobile tires are far more reliable and puncture resistant than their tube based predecessors. However, automobile tires are still susceptible to punctures and other damage while driving resulting in a need to change a wheel with a damaged tire on the side of the road. Many motorists do not subscribe to services that offer roadside assistance and must change their own tire. Although most motor vehicles typically come with a lug wrench for removing and reinstalling lug nuts or lug bolts while changing a tire, such lug wrenches are typically manual, have short handles, a fixed head, and provide no indication of the level of torque when tightening a nut or bolt. A short handled lug wrench is compact for easy storage in a trunk or other vehicle compartment, but makes it difficult or impossible for weaker motorists to remove lug nuts because they are unable to obtain enough leverage. A fixed rather than a pivoting head constrains the angle at which the motorist must work. Not having an indication of the level of torque applied can result in a dangerous situation if the motorist is not mechanically inclined and believes they have tightened the lug nuts on a newly installed spare tire to an acceptable torque level when they have not actually done so. Entirely manual wrenches are also not ideal for removing and installing lug nuts because it can take a significant amount of time to completely remove an already loosened lug nut or to initially tighten a lug nut because the manual wrench must typically be removed and repositioned many times. Greater periods of time spent changing a tire by the side of the road increase the chance that the stranded motorist may be struck by another passing vehicle and also may expose the motorist to inclement weather conditions such as extreme cold, rain, snow, sleet, or extreme heat for greater periods of time.

Although not specifically targeted to the specific use of changing the wheels of motor vehicles, various types of torque wrenches are known, including mechanical torque wrenches and electronic torque wrenches that use electronic circuitry for measuring or indicating torque values. For example, U.S. Pat. No. 6,526,853, titled Electromechanical Releasing Torque Wrench, to Jenkins, U.S. Pat. No. 7,234,378, titled Digital Torque Wrench, to Reynertson, Jr., and U.S. Pat. No. 6,981,436, titled Electronic Torque Wrench, to Becker et al., each describe a torque wrench having an electronic torque setting and/or display component. However, all of the torque wrenches described in these patents are manually operated and do not include any type of motorized tightening or loosening capability. Additionally, although U.S. Pat. No. 6,981,436 describes inner and outer telescoping housing portions, these portions appear to be telescopic only in the sense that they are telescopically connected when assembling the wrench or inserting a battery tray. However, that wrench is not described as being usable at multiple lengths. Becker et al. appear to teach away from telescopic operation because the wrench is described as being held together by a single screw that would prevent any elongation or shortening of the wrench.

Various types of powered wrenches are also known, but they generally do not include electronic torque setting, measuring and display devices, are typically tethered to an electrical power cord or pneumatic supply hose, or have other limitations that limit their usefulness in the situations described above. As an example, in U.S. Pat. No. 7,069,816, titled Motor-Driven Screw Driver, Saathoff et al. describe a motor-driven screw driver that includes a torque limiter, but the screw driver includes a fixed rather than a pivoting head, uses separate torque limiters for motorized and manual operation, and makes no mention of the possibility of telescopic operation. Accordingly, there is a need for a cordless motor assisted torque wrench with a pivoting head and other features which would enable a mechanically unsophisticated user to safely change a tire or the like in an adverse environment.

SUMMARY OF THE INVENTION

It is therefore an object of the present invention to provide a cordless motor assisted torque wrench with a pivoting head.

It is a further object of the invention to achieve the above object in a cordless motor assisted torque wrench that enables a mechanically unsophisticated user to safely change a tire or the like in an adverse environment.

The invention achieves these and other objects and advantages which will become apparent from the following description by providing a torque wrench that includes an elongated housing adapted to enclose an elongated battery pack, a drive head pivotably connected to a first end of the elongated housing at a pivot connection, an electronic torque setting device operable to receive a desired torque setting from a user, a torque sensing device for sensing a level of torque applied by the wrench to a workpiece, a motor disposed within the head, and a torque limiter configured to limit the torque applied by the wrench to a workpiece based on the desired torque setting and the level of torque sensed by the torque sensing device.

In the preferred embodiments, the elongated housing preferably includes a first segment and a second segment slidably coupled to form a telescopic elongated housing that is configurable into at least two lengths. The invention may also include a processing device in signal communication with the torque setting device, the torque sensing device, and the motor to receive a desired torque level from the torque setting component, process signals received from the torque sensing device, and control the motor based on the desired torque level and the processed signals from the torque sensing device.

DETAILED DESCRIPTION OF THE PREFERRED EMBODIMENT

Figure 1:
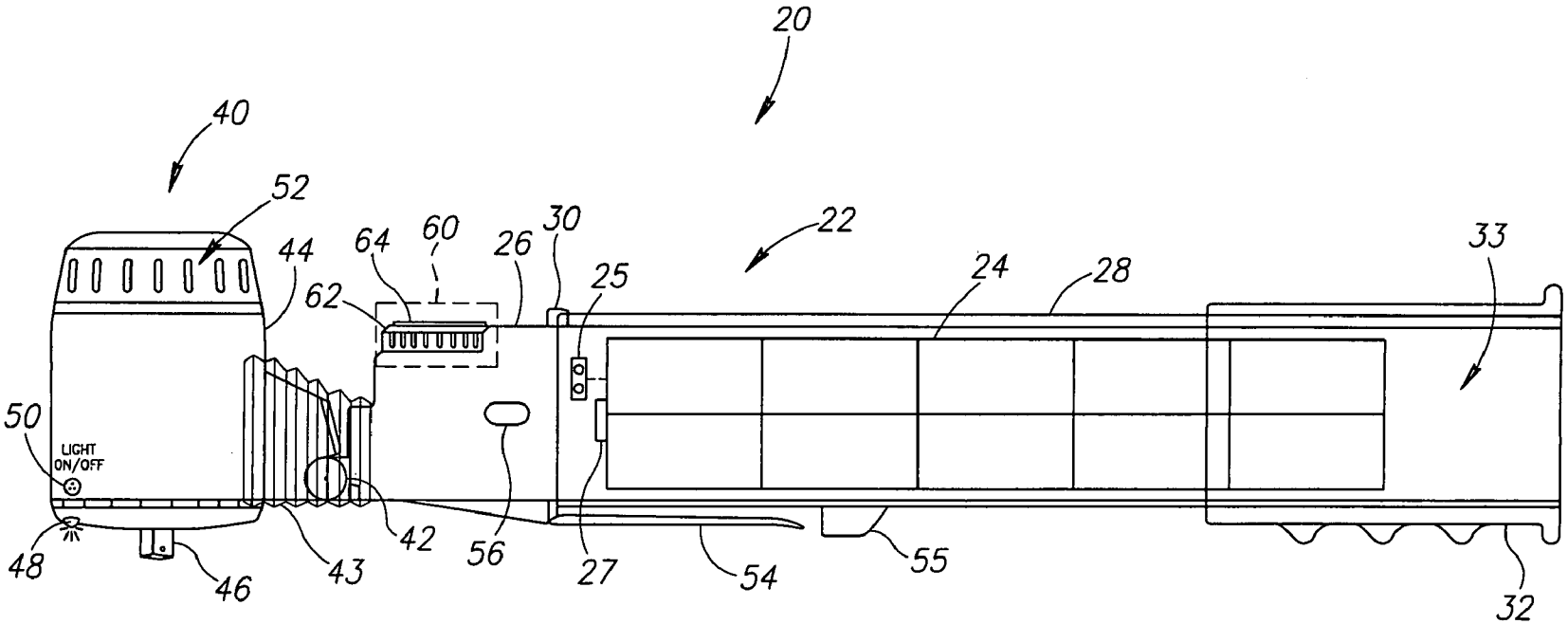
FIG. 1 is a left side elevational view of a cordless motor assisted torque wrench formed in accordance with an embodiment of the invention.

A cordless motor assisted torque wrench formed in accordance with the principles of the invention is generally indicated at reference numeral 20 in the various Figures of the attached drawings wherein numbered elements in the Figures correspond to like numbered elements herein.

Figure 2:
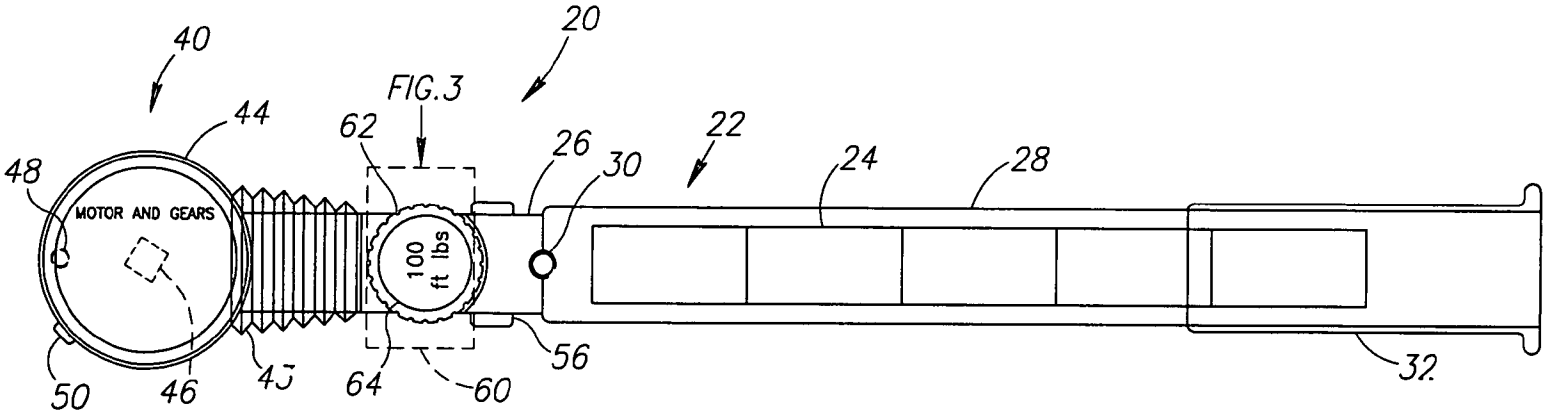
FIG. 2 is a top plan view of the cordless motor assisted torque wrench shown in FIG. 1.

As best seen in FIGS. 1 and 2, the torque wrench 20 includes an elongated housing 22 adapted to enclose an elongated battery pack 24. The battery pack may be a rechargeable lithium-ion battery pack, for example, that may be charged by connecting a recharging cord between a recharging port such as a jack 25 on the torque wrench 20 and a 12 volt receptacle in a motor vehicle. Although ten cells are shown in the battery pack 24, battery packs having different numbers of cells may also be used such as a six celled battery pack, for example. The battery pack 24 is also preferably removable from the wrench 20 so that it may be replaced if needed. One or more conventional temperature sensors 27 are preferably located near the battery pack 24 so that recharging or other operations can be shut down if the temperature of the battery pack 24 exceeds a predefined threshold. A pull-out cord (not shown) can also be included in the torque wrench 20 in some embodiments. The pull-out cord allows the torque wrench 20 to operate using a vehicle's 12 volt battery. In a preferred embodiment, the elongated housing 22 includes a first segment 26 slidably coupled to a second segment 28 to form a telescopic elongated housing that is configurable into at least two lengths. The elongated housing 22 is preferably formed of type 6061-T6 aluminum. In FIG. 1, the elongated housing 22 is shown at a first length in a shortened, closed position. The elongated housing 22 is held in place by a sliding handle release button 30 that extends outwardly and locks automatically under spring bias (not shown) when the elongated housing 22 is closed. In the embodiment shown, a contoured grip 32 is located at a first end of the elongated housing 22. The pull-out cord (not shown) is preferably located in a region 33 within the elongated housing 22. In a preferred embodiment, the region 33 includes a distance of approximately 3.75 inches between an end of the battery pack 24 and an end of the wrench 20.

Figures 5, 5A:
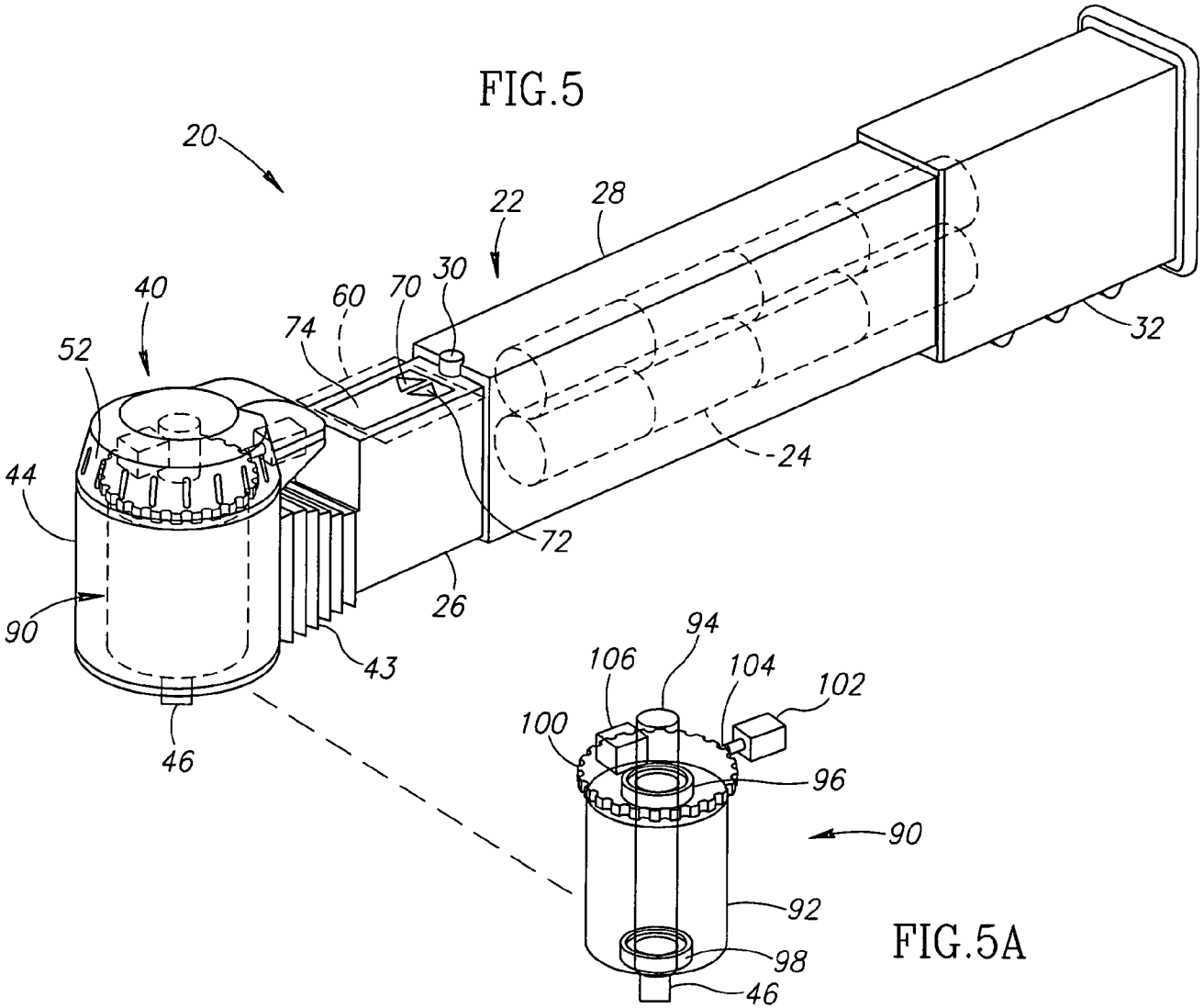
FIG. 5 is an isometric view of an alternative embodiment of the torque wrench.
FIG. 5A is an enlarged, perspective view of dashed area 90 of FIG. 5.

With reference also to FIGS. 5 and 5A, a drive head 40 is pivotably connected to a second end of the elongated housing 22 at a pivot connection 42. A flexible covering boot 43 covers the pivot connection 42. The drive head 40 includes an enclosure 44 that contains a motor and ratchet drive assembly 90 that includes a motor 92. The drive head 40 powers a drive member 46 that may be coupled to sockets or other drive tool components such as an adapter structured to receive screwdriver bits having a hexagonal shaft cross-section, for example. In the preferred embodiment, the drive member 46 is a ⅜" square drive. However, other drive member 46 shapes and sizes may also be used. The drive head 40 also includes a light 48 such as a white light emitting diode (LED), for example, that is controlled by a light switch 50 located on a side of the enclosure 44. The drive head 40 may also include a plurality of air vents 52 located at a top portion of the enclosure 44 to allow for air flow around the motor 92. The drive head 40 is powered by the battery pack 24 and controlled by a trigger style on/off switch 54 preferably located on an underside of the handle first segment 26. In a preferred embodiment, a trigger guard 55 is located on an underside of the second handle segment 28 to reduce accidental triggering of the on/off switch 54. A push-through type motor direction switch 56 extends through the elongated housing 22. The on/off switch 54 may also allow motor speed control in some cases by providing variable amounts of power to the motor from the battery pack 24 depending on the degree to which the switch 54 is engaged by a user. An alternate embodiment of switch 56 is shown in FIG. 3 and is described in further detail below.

As best seen in FIG. 2, a torque wrench user interface 60 allows a user to enter a desired torque setting and in some embodiments may also display a level of currently applied torque when the torque wrench 20 is in use. In the embodiment shown, the torque wrench user interface 60 includes a torque setting dial 62 that rotates about a display 64, such as a liquid crystal display (LCD). A level of desired torque may be increased by rotating the dial 62 in a clockwise direction and decreased by rotating the dial 62 in a counterclockwise direction. In other embodiments, the rotational effect of the dial 62 may be reversed.

Figure 3:
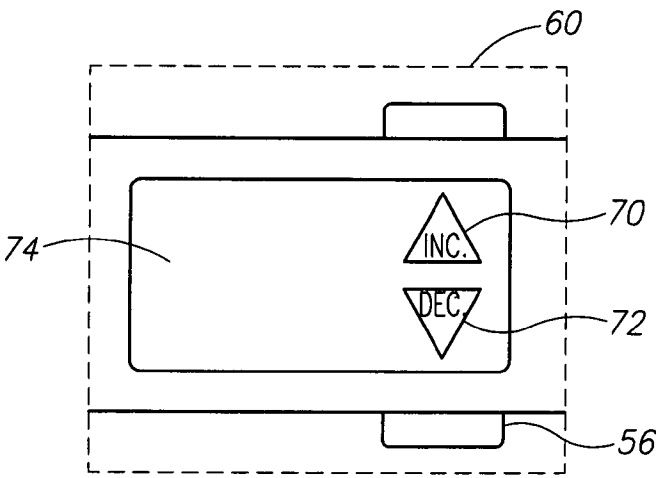
FIG. 3 is an enlarged view of dashed area 60 of FIG. 2 showing a torque wrench user interface in accordance with an alternative embodiment of the invention.

FIG. 3 shows an alternative embodiment of the torque wrench user interface 60 in accordance one embodiment of the invention. In the embodiment shown, the user interface 60 includes an increase button 70, a decrease button 72, and a display area 74. As for the display 64, the display area 74 may be an LCD, for example. Pressing the increase button 70 corresponds to a clockwise rotation of the dial 62 and pressing the decrease button corresponds to a counterclockwise rotation of the dial 62 in one example, such that the desired level of torque is increased when the increase button 70 is pressed and decreased when the decrease button 72 is pressed. Although only an increase button 70 and a decrease button 72 are shown, different numbers of buttons or a touch sensitive display may also be used.

Figure 4:
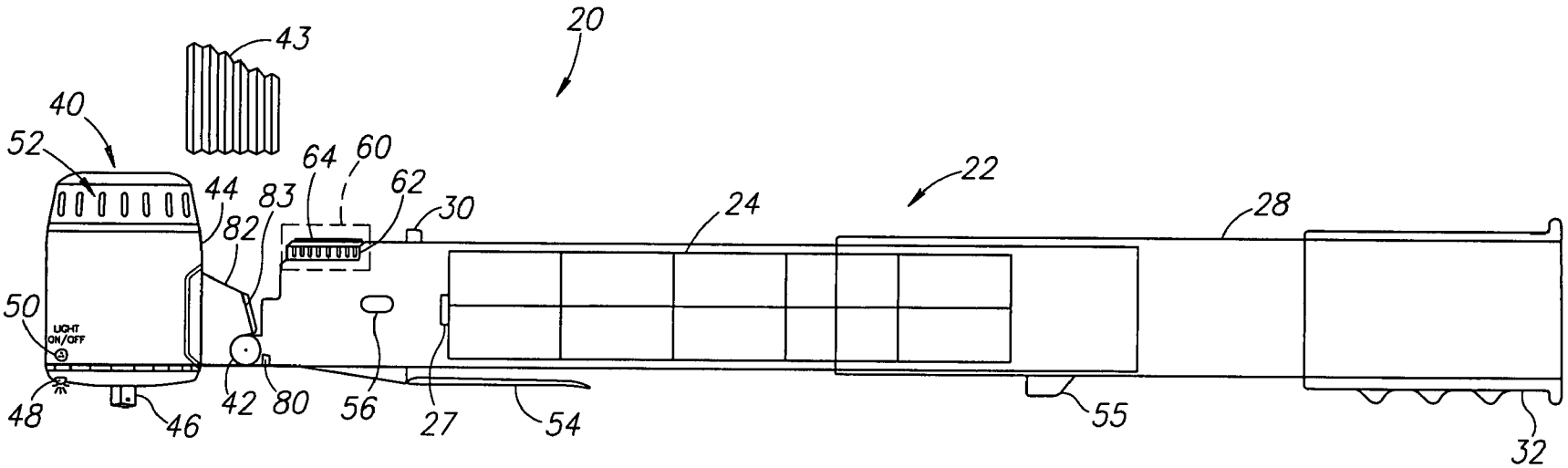
FIG. 4 is a left side elevational view of the torque wrench in an extended position with a covering boot removed.

FIG. 4 shows the torque wrench 20 with the covering boot 43 removed. The second segment 28 of the elongated housing 22 is shown in a second extended position as compared to the first closed position shown in FIGS. 1 and 2. This advantageously results in a longer handle and a corresponding greater degree of leverage that allows a user of the torque wrench 20 to more easily apply a higher level of torque as compared to when the torque wrench 20 is in the closed position. The sliding handle release button 30 operates to keep the torque wrench 20 in the extended position until the user releases the button 30. Alternatively, in an additional example, the button 30 may only lock the torque wrench 20 in the closed position and an additional handle locking mechanism (not shown) may operate to keep the torque wrench 20 in the extended position until the user releases the locking mechanism. The additional handle locking mechanism (not shown) preferably includes a click detent that requires approximately eight pounds of force to overcome. By being configurable into at least two lengths, the torque wrench 20 may be more easily stored in a vehicle compartment such as a trunk while in the shortened position while still providing a significant degree of leverage to a user when in the elongated position. In a preferred embodiment, the torque wrench 20 is approximately 18 inches long when in the closed position and approximately 25 inches long when in the elongated position.

With the covering boot 43 removed, it can be seen that the pivot connection 42 pivotably connects a protruding portion 80 of the first segment 26 of the elongated housing 22 to a connecting member 82 that protrudes from the drive head 40. Preferably, grooves on the enclosure 44 and the protruding portion 80 are used to secure the covering boot 43 in place. In the example shown, a face of the connecting member 82 is angled such that the drive head 40 may pivot about the pivot connection 42 toward the top surface of the elongated housing 22 to an angle of about 15 degrees from a horizontal reference before being stopped by the angled face of the connecting member 82 contacting an upper part of the protruding portion 80. A bumper 83 is preferably located on the angled face of the connecting member 82 to provide a cushioning effect when the connecting member 82 contacts the upper part of the protruding portion 80. In a preferred embodiment, the bumper 83 is formed of rubber and is approximately 0.075 inches thick. Allowing some pivotal movement facilitates a more comfortable working position for a user while constraining the degree of pivotal movement still allows the user to apply force toward an item such as a lug nut that is being worked upon by the torque wrench 20. Although an angle of 15 degrees is used in this example, other embodiments may use different angles.

FIG. 5 illustrates an alternative embodiment of the torque wrench 20. A motor and ratchet drive assembly 90 is shown in dashed lines within the enclosure 44. The motor and ratchet drive assembly 90 is also shown separate from the torque wrench 20 in FIG. 5A so that various components of the assembly 90 are visible. The assembly includes a direct current (DC) motor 92 having a shaft 94 rotatable within a first bearing 96 and a second bearing 98. The shaft 94 terminates at one end at the drive member 46. A locking gear 100 is journaled for rotation with the shaft 94 and is engaged by a solenoid 102 and ball 104 combination to prevent rotation of the shaft 94. The ball 104 is preferably a stainless steel ball bearing. A torque sensing device 106 senses torque applied by the motor and ratchet drive assembly 90 and releases the ball 104 from the locking gear 100 when the desired torque is sensed by the torque sensing device 106.

Figure 6:
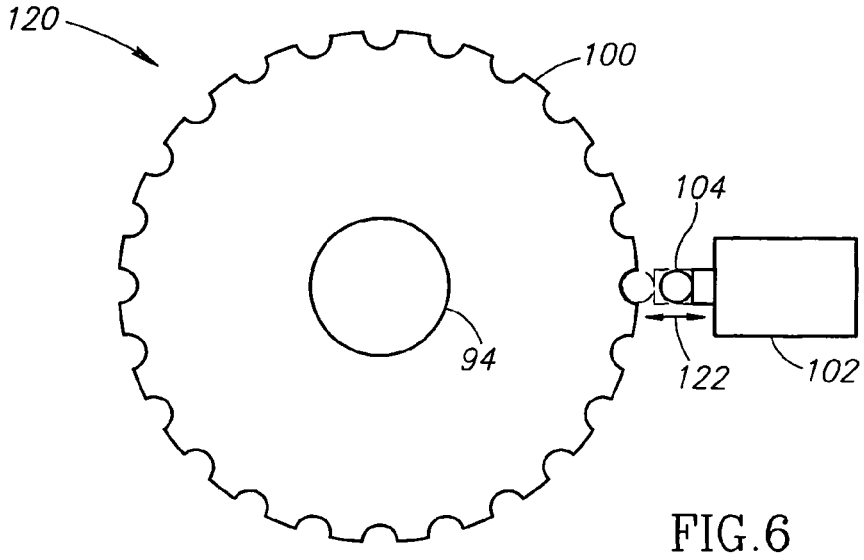
FIG. 6 is a diagram of a torque wrench locking gear mechanism.

FIG. 6 shows a torque wrench locking gear mechanism 120. The locking gear mechanism 120 includes the locking gear 100, the solenoid 102, and the ball 104. The solenoid 102 may be activated to move the ball 104 from a first position shown with a solid line to a second position shown with a dashed line along the direction of a movement indicator arrow 122. When the ball 104 is in the second position, the locking gear 100 and the shaft 94 are prevented from rotating with respect to the solenoid 102. Although a locking gear, solenoid, and ball are used as the locking gear mechanism 120 in this example, the locking gear mechanism may be structured differently in other embodiments. In addition to the locking gear mechanism 120, the torque wrench 20 may also include a conventional ratcheting mechanism (not shown) to allow manual ratcheting operation of the torque wrench 20 if desired by a user.

Figure 7:
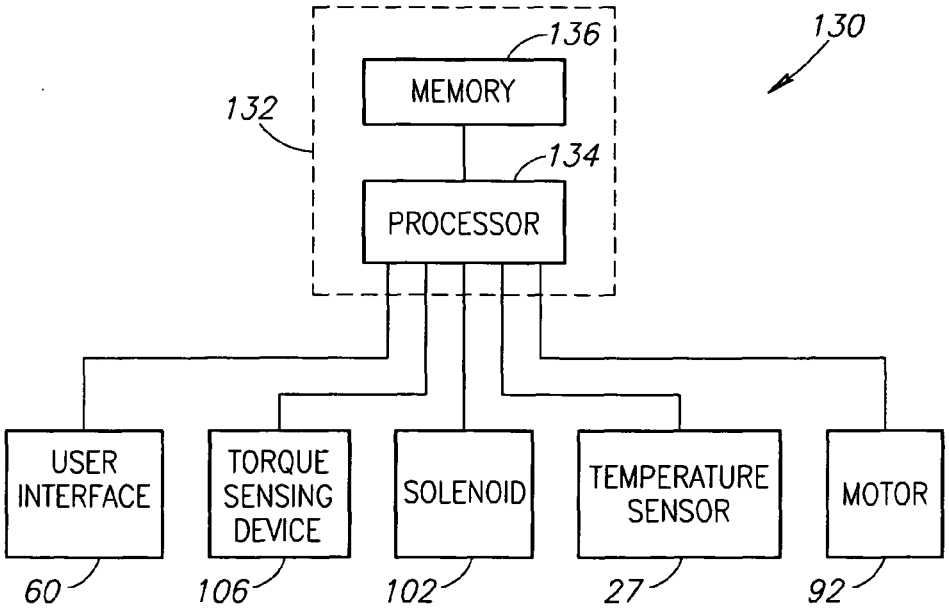
FIG. 7 is a block system diagram in accordance with an embodiment of the invention.

FIG. 7 is a block diagram of a system 130 formed in accordance with the preferred embodiment of the invention. The system 130 includes a processing device 132 having a processor 134 (such as a conventional microprocessor or microcontroller) in data communication with a conventional solid state memory 136. Although not all components of the system 130 are shown in FIG. 1, 2, 4, or 5, it should be understood that all components of the system 130 are preferably included in the torque wrench 20, including the processing device 132. The memory 136 may include volatile and/or nonvolatile memory. The processor 134 is in signal communication with the user interface 60, the motor 92, the torque sensing device 106, and the solenoid 102. In operation, a user may enter a desired torque level at the user interface 60. The torque sensing device 106 senses the current level of torque applied by the torque wrench 20. The processor 134 compares the desired torque level entered at the user interface 60 to the current level of torque applied as sensed by the torque sensing device 106. If the current level of torque is less than the desired level of torque, the processor sends a signal to the solenoid 102 to cause the solenoid to enter into or remain in a contracted position so that the shaft 94 is able to rotate. If the user has activated the on/off switch 54 by placing the switch 54 in an on position, the motor 92 turns the shaft 94 to apply additional torque to an item being worked upon. In some examples, the processor 134 also sends signals to the motor 92 or a motor controller (not shown) to vary the speed of the motor 92 as the desired torque level is approached. In a preferred embodiment, the processor 134 is also in signal communication with the temperature sensor 27 and shuts down recharging or other operations if the temperature of the battery pack 24 exceeds a predefined threshold.

In situations where a user desires to tighten or loosen a nut or other workpiece at a torque level that is greater than a predefined maximum level of torque as determined by a torque level rating of the motor 92 and/or a level of charge left in the battery pack 24, the user may also manually loosen or tighten the workpiece. For example, if the battery pack 24 is fully charged and the motor 92 has a maximum torque level rating of 50 ft-lbs, a user may tighten a nut such as a lugnut on a motor vehicle by rotating the dial 62 until a correct torque level setting appears on the display 64. The user then attaches an appropriate socket and possibly an extension to the drive member 46, positions the socket over the nut, makes sure the motor direction switch 56 is set to forward, and engages the on/off switch 54 to turn the motor on. The processor 134 directs the solenoid 102 to disengage the ball 104 from the locking gear 100, which allows the motor 92 to turn the drive member 46 and socket while the elongated housing 22 remains in a substantially fixed position. The motor 92 then spins to tighten the nut. If the desired torque setting is less than 50 ft-lbs, the processing device 132 causes the tightening to stop at the desired torque setting by directing the solenoid 102 to engage the ball 104 in the locking gear 100 and/or by turning the motor 92 off. If the desired torque setting is greater than the predefined maximum level of torque (50 ft-lbs in this example), the processing device 132 directs the solenoid 102 to engage the ball 104 in the locking gear 100 and turns the motor 92 off when the torque sensing device 106 indicates the maximum level has been reached. The user is then able to continue my manually tightening the nut until the user sees on the display 64 that the desired torque has been applied. Alternatively, the torque wrench 20 may include a notification such as a beeping sound that is activated when the desired torque has been applied so the user does not need to monitor the display 64. In a similar fashion, nuts or other workpieces that are being loosened from a torque level greater than the maximum torque level may be loosened manually by a user before being removed the rest of the way using the motor 92. Such manual operation for high torque levels may be made easier for some users by extending the elongated housing 22 to the second lengthened position to obtain greater leverage.

While the preferred embodiment of the invention has been illustrated and described, as noted above, many changes can be made without departing from the spirit and scope of the invention. For example, in some embodiments Nickel-Cadmium or other types of rechargeable batteries rather than Lithium-Ion rechargeable batteries may be used or alternatively, non-rechargeable batteries may be used. Additionally, those of ordinary skill in the art will conceive of other alternate embodiments of the invention upon reviewing this disclosure. Accordingly, the scope of the invention is not limited by the disclosure of the preferred embodiment. Instead, the invention should be determined entirely by reference to the claims that follow.

I claim:

1. A cordless motor assisted torque wrench comprising:

an elongated housing adapted to enclose an elongated battery pack;

a drive head pivotably connected to a first end of the elongated housing at a pivot connection;

a ratchet drive located within the head;

an electronic torque setting component operable to receive a desired torque setting from a user;

an electronic torque sensing device for sensing a level of torque applied by the wrench to a workpiece;

a motor disposed within the head, the motor powered by the enclosed battery pack; and an electronic torque limiter configured to limit the torque applied by the wrench to the workpiece based on the desired torque setting received at the torque setting component and the level of torque sensed by the torque sensing device;

a processing device in signal communication with the torque setting component, the torque sensing device, and the motor to receive a desired torque level from the torque setting component, process signals received from the torque sensing device, and control the motor based on the desired torque level and the processed signals from the torque sensing device, wherein the head includes a locking mechanism to allow the motor to turn while the housing remains stationary to apply a first torque to a workpiece when the locking mechanism is disengaged and to allow a user to manually operate the torque wrench to apply a second greater torque to the workpiece when the locking mechanism is engaged, and wherein the locking mechanism includes a solenoid that engages and disengages a ball from a locking gear, and wherein the processing device is also in signal communication with the solenoid.

* * * * *